US012331594B2

(12) United States Patent
Atkins et al.

(10) Patent No.: US 12,331,594 B2
(45) Date of Patent: Jun. 17, 2025

(54) FIXED CUTTER DRILL BIT WITH REFINED SHAPED CUTTER PLACEMENT

(71) Applicant: Halliburton Energy Services, Inc., Houston, TX (US)

(72) Inventors: William Brian Atkins, Houston, TX (US); Ryan Joseph Murphy, Midland, TX (US); Carlos Fernando Galarraga Canizares, Midland, TX (US); Jason Kent Bratcher, Montgomery, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 330 days.

(21) Appl. No.: 17/700,194

(22) Filed: Mar. 21, 2022

(65) Prior Publication Data

US 2023/0028472 A1 Jan. 26, 2023

Related U.S. Application Data

(60) Provisional application No. 63/225,233, filed on Jul. 23, 2021.

(51) Int. Cl.
*E21B 10/627* (2006.01)
*E21B 10/567* (2006.01)

(52) U.S. Cl.
CPC ..... *E21B 10/627* (2013.01); *E21B 10/5673* (2013.01); *E21B 2200/20* (2020.05)

(58) Field of Classification Search
CPC . E21B 10/627; E21B 10/5673; E21B 2200/20
See application file for complete search history.

(56) References Cited

U.S. PATENT DOCUMENTS

| | | | | |
|---|---|---|---|---|
| 9,115,552 | B2 * | 8/2015 | Chen | G06F 30/17 |
| 2006/0167669 | A1 * | 7/2006 | Cariveau | E21B 10/00 703/7 |
| 2009/0055135 | A1 * | 2/2009 | Tang | G06F 30/17 703/7 |
| 2013/0035902 | A1 * | 2/2013 | Endres | E21B 10/00 703/2 |
| 2014/0095134 | A1 * | 4/2014 | Cariveau | E21B 10/00 703/7 |
| 2016/0290056 | A1 | 10/2016 | Propes et al. | |
| 2017/0107768 | A1 | 4/2017 | Saini et al. | |
| 2018/0010396 | A1 | 1/2018 | Dunbar et al. | |
| 2020/0018122 | A1 | 1/2020 | Keller et al. | |
| 2020/0040662 | A1 | 2/2020 | Atkins et al. | |
| 2020/0386055 | A1 | 12/2020 | Chen | |
| 2021/0381317 | A1 | 12/2021 | Atkins | |

* cited by examiner

*Primary Examiner* — Kibrom K Gebresilassie
(74) *Attorney, Agent, or Firm* — Michael Jenney; C. Tumey Law Group PLLC

(57) ABSTRACT

In one example, a method of designing a drill bit comprises obtaining a baseline orientation of a shaped cutter with respect to a bit body. The shaped cutter includes a shaped cutting element secured to a substrate. The baseline orientation is defined, at least in part, with respect to an rotational position of the shaped cutting element about a longitudinal axis of the shaped cutter. A wear imbalance is determined between opposing portions of the shaped cutting element at the baseline orientation. An adjusted orientation of the shaped cutter is generated having a different rotational position of the shaped cutting element about the cutter axis expected to reduce the wear imbalance.

14 Claims, 9 Drawing Sheets

FIXED CUTTER DRILL BIT WITH REFINED SHAPED CUTTER PLACEMENT

CROSS-REFERENCE TO RELATED APPLICATIONS

The present application is a non-provisional of U.S. Patent Application No. 63/225,233, filed on Jul. 23, 2021, the entirety of which is incorporated herein by reference.

BACKGROUND

Wells are constructed in subterranean formations in an effort to extract hydrocarbon fluids such as oil and gas. A wellbore may be drilled with a rotary drill bit mounted at the lower end of a drill string. The drill string is assembled at the surface of a wellsite by progressively adding lengths of tubular drilling pipe to reach a desired depth. The drill bit is rotated by rotating the entire drill string from the surface of the well site and/or by rotating the drill bit with a downhole motor incorporated into a bottomhole assembly (BHA) of the drill string. As the drill rotates against the formation, cutters on the drill bit disintegrate the formation in proximity to the drill bit, wherein the removed formation material is generally referred to as cuttings. Drilling fluid ("mud") is circulated along the drill string, usually along an interior of the drill string, through the bit, and up an annulus between the drill string and the wellbore, to continually remove the cuttings to surface. Rotary drill bits are generally categorized as cutting element (FC) bits having individual cutters secured to a bit body at fixed positions (i.e., fixed cutters), roller cone (RC) bits wherein the cutters are secured to rolling cutting structures (i.e., roller cones), or hybrid bits comprising both fixed cutters and rolling cutting structures. Fixed cutter bits are used in a majority of drilling applications. A fixed cutter typically has a diamond-based cutting element secured to a metal carbide substrate. The substrate is secured to the bit body with the cutting element at a particular orientation and position, thereby exposing some portion of the fixed cutter to the formation. The construction of cutters and their placement on the bit are the focus of continuing evolution of fixed cutter bits. Refinements to these aspects can, in some cases, lead to significant improvements in drill bit performance and longevity, including certain refinements that visually may seem subtle or nuanced.

BRIEF DESCRIPTION OF THE DRAWINGS

These drawings illustrate certain aspects of some of the embodiments of the present disclosure and should not be used to limit or define the method.

DETAILED DESCRIPTION

Disclosed herein is a drill bit having a plurality of fixed cutters, including one or more shaped cutters with refined shaped cutter placement. A fixed cutter is typically cylindrical, with a round cutting element and planar cutting face. By contrast, a shaped cutter, as disclosed herein, may instead have a cutting element with a non-circular and/or non-planar cutting face that gives the cutter directionality about its longitudinal axis (i.e., cutter axis). Still other cutters may have a cutting element with a non-cylindrical but still circular cross-sectional shape, e.g. a frustoconical or otherwise axially-tapering cutting element. A drill bit according to this disclosure may include any combination of the foregoing cutter types. In one aspect of this disclosure, the placement of the shaped cutters on a drill bit is refined by adjusting their orientations in a way that improves cutting performance. Improving cutting performance may comprise reducing a wear imbalance. The reduction in wear imbalance or other improvements in cutting performance may be as compared with a baseline orientation of the shaped cutters or other baseline values of the drill bit design. In several disclosed examples, adjusting the orientation of the shaped cutter includes adjusting the rotational position of the shaped cutter about its cutter axis to change how it engages the formation. Related aspects of this disclosure include a method of designing a drill bit having the disclosed attributes and a method of drilling with such a drill bit.

In at least one example, a method of designing a drill bit comprises obtaining a baseline orientation of a shaped cutter with respect to a bit body. The shaped cutter includes a shaped cutting element secured to a substrate. The baseline orientation is defined with respect to a rotational position of the shaped cutting element about a longitudinal axis of the shaped cutter (i.e., the cutter axis). A wear imbalance is determined, such as between opposing portions of the shaped cutting element, at the baseline orientation. An adjusted orientation of the shaped cutter is generated having a different rotational position of the shaped cutting element about its cutter axis expected to reduce the wear imbalance as compared with an expected wear imbalance that may otherwise occur at the baseline orientation. The design method may be performed, at least in part, using an electronic model of a prospective drill bit suitable for a particular drilling application and/or by simulating drilling using that electronic model. Alternatively, or in addition, the design method may include drilling a test well using a physical test bit and then investigating the performance characteristics, including wear of the shaped cutters. The method may be iterative, starting with a baseline orientation of shaped cutters, and with one or more iterations using adjusted orientations of the shaped cutters.

Figure 1:
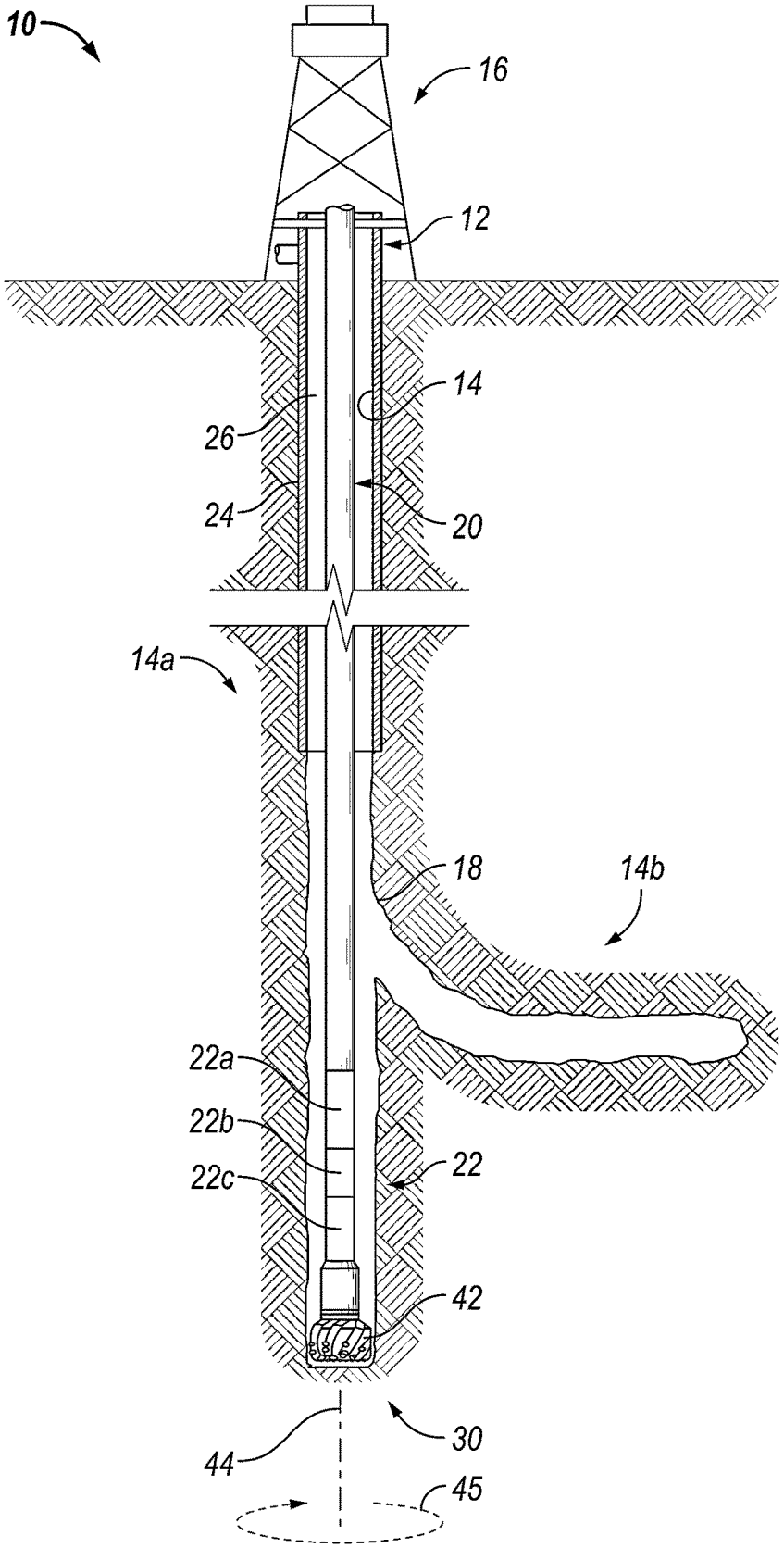
FIG. 1 is an elevation view of an example drilling system in which a shaped cutter drill bit according to this disclosure may be used to drill a wellbore.

FIG. 1 is an elevation view of an example drilling system 10 in which a drill bit 40 may be used to drill a wellbore 14. The drill bit 40 may include shaped cutters whose placement is selected according to aspects of this disclosure. The drilling system 10 may include a well site at an above ground location (i.e., at the surface) 12. Various types of drilling equipment such as a rotary table, drilling fluid pumps and drilling fluid tanks (not expressly shown) may be located at the surface 12. For example, a drilling rig 16 may be provided with various features associated with terrestrial drilling operations with a "land drilling rig." However, teachings of the present disclosure may be satisfactorily applied in offshore drilling operations, e.g., operations with drilling equipment located on offshore platforms, drill ships, semi-submersibles and drilling barges (not expressly shown). The drilling system 10 includes a drill string 20 with the drill bit 40 secured at a lower end for forming a wide variety of wellbores 14. The wellbore 14 may include a main bore 14*a* and any number of wellbore branches 14*b*. The wellbore 14 may be a multilateral wellbore, including a main wellbore 14*a* and at least one wellbore branch 14*b* that deviates from vertical. The wellbore branch 14*b* may be formed, for example, using a whipstock assembly at a multilateral junction 18. Various directional drilling techniques may also be used to control the direction of drilling of the wellbore(s) in an effort to reach one or more target zones.

The BHA 22 may include the drill bit 40 and any number of other BHA components, schematically depicted at 22*a*, 22*b* and 22*c*, coupled to the drill string 20 above the drill bit 40. The BHA components 22*a*, 22*b* and 22*c* may include, but are not limited to, drill collars, rotary steering tools, directional drilling tools, downhole drilling motors, reamers, hole enlargers, stabilizers etc. The number and types of BHA components 22*a*, 22*b* and 22*c* may depend on anticipated downhole drilling conditions and the type of wellbore 14 that will be formed by drill string 20 and rotary drill bit 40. The BHA 22 may also include various types of well logging tools (not expressly shown) and other downhole tools associated with directional drilling of a wellbore. Examples of logging tools and/or directional drilling tools may include, but are not limited to, acoustic, neutron, gamma ray, density, photoelectric, nuclear magnetic resonance, rotary steering tools and/or any other commercially available well tool. The BHA components 122*a*, 122*b* and 122*c* may also include a downhole motor capable of rotating the drill bit 40 with respect to an upper portion of the drill string 20. The wellbore 14 may be drilled by engaging the drill bit 40 with the formation while rotating the drill bit 40, such as by rotating the entire drill string 20 from the surface and/or by rotating the drill bit 40 with the mud motor.

The wellbore 14 may be defined in part by a casing string 24 that may extend from surface 12 to a selected downhole location. Portions of wellbore 14 illustrated in FIG. 1 that do not include casing string 24 may be described as "open hole." Various types of drilling fluid, or "mud," may be pumped from the surface 12 through drill string 20. The drilling fluids may be expelled from the drill string 20 through nozzles passing through the drill bit 40. The drilling fluid may be circulated back to surface 12 through an annulus 26 defined between an outside diameter of the drill string 20 and a surrounding structure. Along an open hole portion, the annulus 26 is defined between the drill string 20 and an inside diameter of the wellbore 14*a*. The inside diameter may be referred to as the "sidewall" of the wellbore 14*a*. Along a cased portion, the annulus 26 may be defined between the drill string 20 and an inside diameter of the casing string 24.

The drill bit 40 includes one or more blades 42 that project or extend outwardly. A plurality of fixed cutters are secured along the blades 42, as further discussed below in connection with subsequent figures. Drill bit 40 may rotate with respect to a bit rotational axis 44 in a direction defined by directional arrow 45. As the drill bit 40 is rotated, the fixed cutters on the blades 42 may cut the formation, where cutting may comprise scraping, gouging, shearing, or otherwise disintegrating the formations surrounding wellbores 14, causing pieces of rock to separate from the formation (i.e., the cuttings). Those cuttings may be continuously removed by the drilling fluid circulated through the drill string 20 back to the surface 12, where the cuttings may be removed from the drilling fluid by surface equipment.

Figure 2:
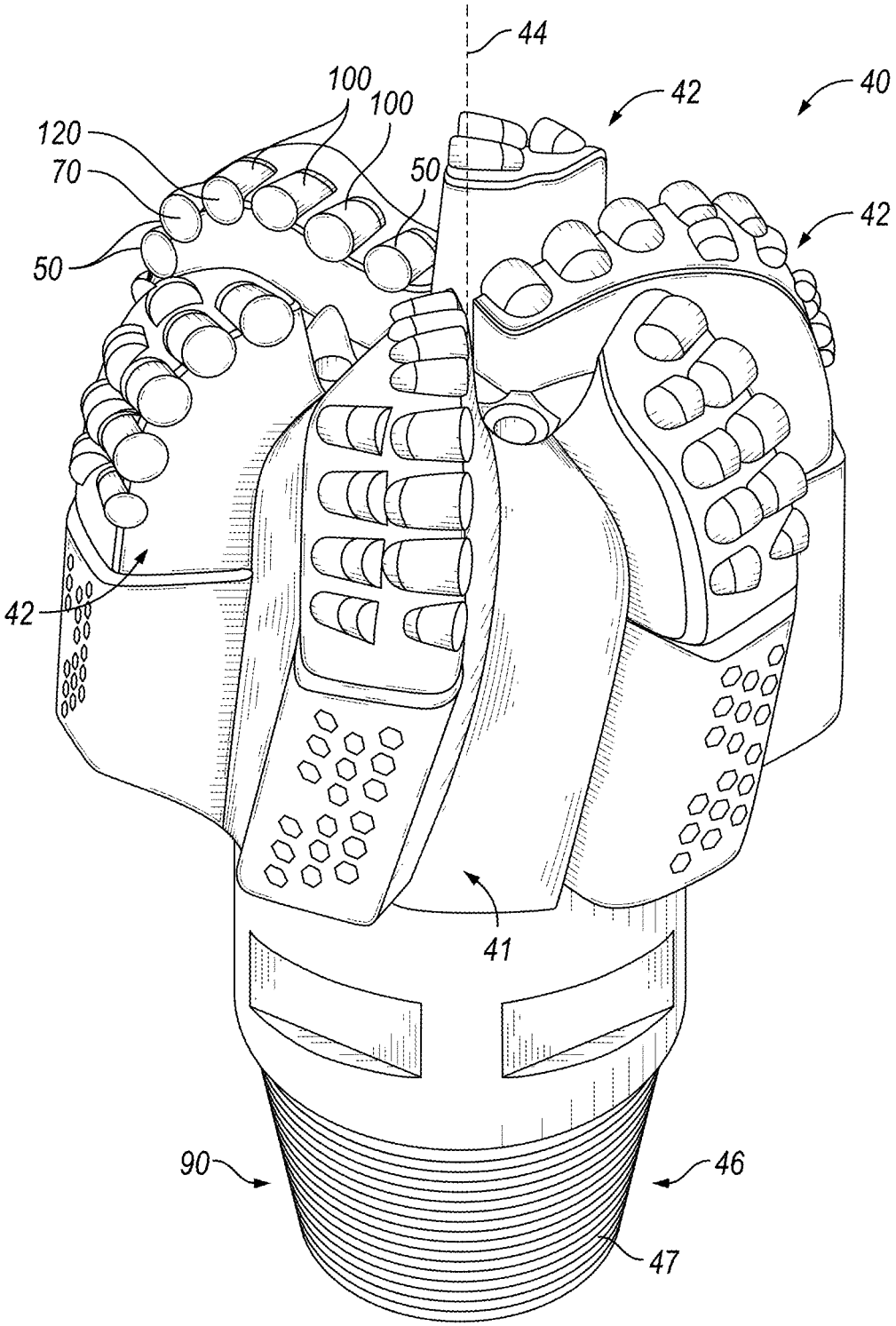
FIG. 2 is an isometric view of the drill bit according to an example configuration having a plurality of round cutters and shaped cutters disposed thereon.

FIG. 2 is an isometric view of the drill bit 40 according to an example configuration having both round cutters 50 and shaped cutters 100. The drill bit 40 is oriented upwardly in FIG. 2 for purpose of illustration, such as to show the arrangement of blades 42 and cutters 50, 100. The drill bit 40 in this example has six blades 42 disposed outwardly from a rotary bit body 41. Generally, blades formed in accordance with teachings of the present disclosure may have any of a wide variety of configurations including, but not limited to, substantially arched, helical, spiraling, tapered, converging, diverging, symmetrical, and/or asymmetrical.

The round cutters 50 and shaped cutters 100 are secured along the blades 42 at fixed positions and orientations, which placement may be one of the design parameters according to this disclosure. Each cutter 50, 100 may be placed on the drill bit 40 for a particular purpose, including but not limited to intended use as primary cutters, backup cutters, secondary cutters, gage cutters, and so forth, according to a particular drilling application. Each cutter 50, 100 may be directly or indirectly coupled to an exterior portion of the respective blade 42. For examples, the cutters 50, 100 may be retained in recesses or cutter pockets located on blades 42 of drill bit 40 with a brazing material, welding material, soldering material, adhesive, or other attachment material. Although not required, one or rolling cutter may also be mounted in rolling cutter pockets on the blade allowing the cutter to independently rotate within the rolling cutter pocket about its own cutter axis. With the exception of any rolling cutters, however, the cutters 50, 100 are fixed cutters that are not permitted to rotate about their cutter axes. The shaped cutters, in particular, may be secured to the bit body at a fixed rotational position about their respective cutter axes to improve their performance and the overall bit performance as further detailed below.

The drill bit 40 includes a connector 90 for coupling the drill bit 40 to a drill string. The connector 90 may comprise any suitable connector for a drill bit, some examples of which may be prescribed by a standards body such as American Petroleum Institute (API) based on the bit type, size, drilling application, and other factors. The connector 90 is embodied by way of example here as a shank 46 with drill pipe threads 47 formed thereon. The threads 47 may be used to threadedly connect with corresponding threads on another drill string component to releasably engage the drill bit 40 with a bottom hole assembly included in the drill string. Typically, the bit axis 44 will be aligned with (e.g., co-axial) with an axis of the drill string, although in specific applications like directional drilling the bit axis 44 may be deviated slightly with respect to the axis of the drill string. When coupled to the drill string, the drill bit 40 may be rotated around the bit axis 44 (and/or the axis of the drill string), such as by rotation of the whole drill string or by rotation of the drill bit 40 with respect to other parts of the drill string with a downhole motor in the BHA. Each cutter 50, 100 may include a respective cutting element 70, 120 that is positioned to engage a downhole formation to drill a wellbore by rotation of the drill bit 40.

The drill bit 40 may be designed and manufactured in accordance with teachings of the present disclosure to improve aspects of bit performance. Bit performance can be characterized in terms of performance parameters, such as drilling speed and efficiency, rate of penetration, revolutions per minute (RPM), weight on bit (WOB), borehole diameter and quality, durability, force balancing, stick-slip reduction, and cutter wear, such as uniformity of cutter wear on shaped cutters, to list just some examples. Drill bit design parameters may be any aspect of the drill bit design that affects bit performance. Some drill bit design parameters affecting bit performance are specifically related to the cutters, including but not limited to cutter type, cutter shape, the number of cutters, their spacing, position, and orientation. One bit design parameter of this disclosure relates to the positioning and orientation of the shaped cutters 100, including a rotational position of the shaped cutting element about a longitudinal axis of the shaped cutter (i.e., cutter axis).

A system and method according to the present disclosure may improve drill bit performance relative to some reference (e.g., baseline values) by adjusting one or more bit design parameters including shaped cutter positioning to improve bit performance. One aspect of this bit design may include generating a detailed computer model of the drill bit configuration including a baseline value of the design parameters and adjusting the design parameters such as to refine the placement and/or orientation of the shaped cutters 100 on the blades 42 of the drill bit 40. A related aspect of bit design may include simulating drilling with the detailed computer model of a bit design to compare bit performance at a baseline value of the design parameter(s) with adjusted value(s) of the design parameter(s). This method may include simulating interactions between the various fixed cutters (shaped cutters 50 and round cutters 100) on the drill bit 40 and the geologic formation to determine how the cutters 50, 100 will individually and collectively engage the wellbore 14 in operation. The method may further include adjusting the placement and orientation of at least the shaped cutters 100 to improve performance relative to a baseline value.

Figure 3:
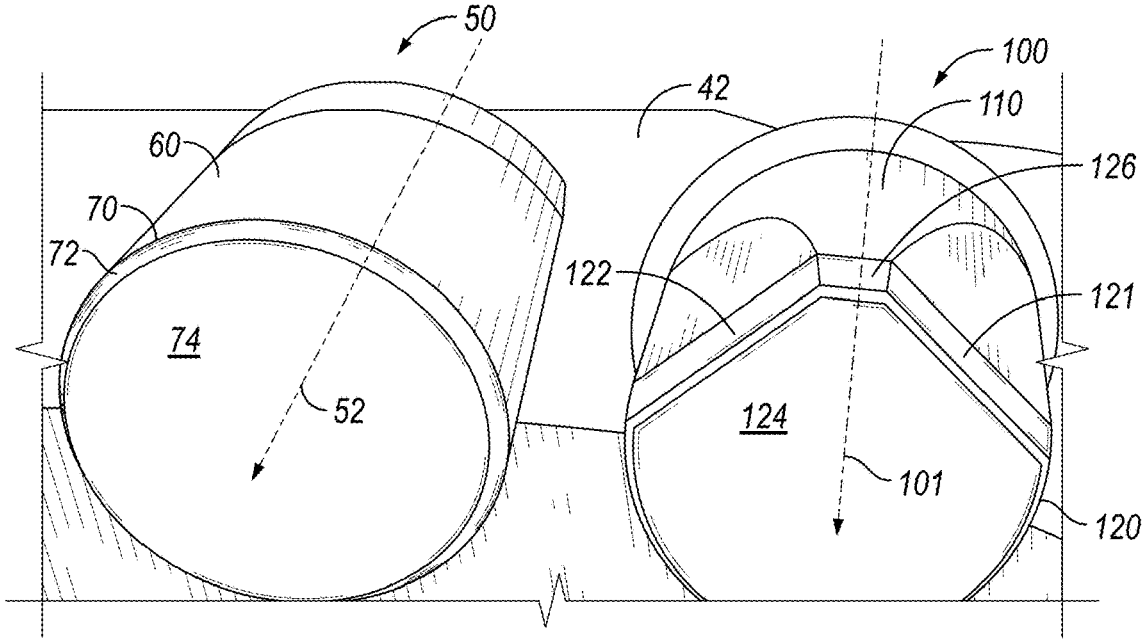
FIG. 3 is a perspective view of a portion of a drill bit blade with a round cutter and a shaped cutter.

FIG. 3 is a perspective view of a portion of a drill bit blade 42 with a round cutter 50 and an adjacent shaped cutter 100. The round cutter 50 and shaped cutter 100 include a respective cutting element 70, 120 secured to and distinct from a respective substrate 60, 110. The cutting elements 70, 120 particularly in that context may be alternately referred to as cutting tables. The substrates 60, 110 may be secured to the blade 42, such as by brazing. The substrates 60, 110 provide a strong, tough base for supporting the cutting elements 70, 120 while drilling. The cutters 50, 100 may be secured to the drill bit blade 42 via the substrates 60, 110 with the cutting elements 70, 120 at particular orientations to expose their cutting elements 70, 120 to the formation when drilling.

Generally, the substrates 60, 110 may be formed from tungsten carbide or other suitable materials associated with forming cutters for rotary drill bits. Tungsten carbides may include, but are not limited to, monotungsten carbide (WC), ditungsten carbide ($W_2C$), macrocrystalline tungsten carbide and cemented or sintered tungsten carbide. A substrate may also be formed using other hard materials, which may include various metal alloys and cements such as metal borides, metal carbides, metal oxides and metal nitrides. Additionally, various binding metals may be included in a substrate, such as cobalt, nickel, iron, metal alloys, or mixtures thereof.

The cutting elements 70, 120 are typically formed from different materials than the substrates 60, 110 that are even harder than the substrate material. Materials used for the cutting elements 70, 120 typically incorporate a diamond material, and may be generally referred to as diamond cutting elements. Examples of materials used to form cutting elements 70, 120 include polycrystalline diamond (PCD), including synthetic polycrystalline diamonds, thermally stable polycrystalline diamond (TSP), and other suitable materials. To form each cutting element, a substrate portion may be placed proximate to a layer of ultra-hard material particles, e.g., diamond particles, and subjected to a high temperature, high pressure (HTHP) press cycle to result in recrystallization and formation of a polycrystalline material layer, e.g., PCD layer. The cutting element may be formed and joined to the substrate in a single HTHP press cycle. Alternatively the cutting element may be formed in a first HTHP press cycle, then subsequently joined to the substrate in another press cycle, or by brazing, bonding, or otherwise securing to the substrate.

Each round cutter 50 has a longitudinal axis (i.e., cutter axis) 52, which may pass centrally through the cutting element 70 and the substrate 60. The cutting element 70 and substrate 60 are themselves cylindrical. The round cutting element 70 typically has a planar cutting face 74 and a constant diameter, aside from minor edge details, like chamfer or bevel along a cutting edge 72. The cutting element 70 may have a planar or non-planar base opposite the cutting face where the cutting element 70 is secured to the substrate 60. The position and orientation of each round cutter 50 may be defined, in part by the orientation of the cutter axis 52 relative to other features of a drill bit, such as a radius from and angle with respect to a drill bit axis. However, the round cutter 50 is considered a round cutter (as opposed to a shaped cutter) according to this disclosure because it has no directional feature in the planar cutting face that would appreciably affect its interaction with rock being cut by a change in the rotational position of the round cutter 50 about its own cutter axis 52.

A shaped cutter according to this disclosure may deviate from a cylindrical cutter by virtue of a non-circular and/or non-planar cutting face of the cutting element. The shaped cutter 100 in the example of FIG. 3 has a generally planar cutting face 124, aside from some chamfering or beveling along the edge, but is considered a shaped cutter according to this disclosure by virtue of its non-circular cutting element 120. The non-circular cutting element 120 has an arcuate portion 126, which may be just a portion of a circle and hence still non-circular. A cutting tip 128 is opposite the arcuate portion 126. The cutting tip 128 is flanked by two opposing portions, referred to in this example as flanks 121, 122, on opposing sides of a centerline 125 (see FIG. 4). The flanks 121, 122 comprise opposing radial reliefs, which are radially inward of a diameter defined by the arcuate portion 126 of the cutting face 124. Thus, unlike the round cutter 50, the rotational position of the shaped cutter 100 about its longitudinal axis (i.e., cutter axis) 101 may affect how the shaped cutting element 120 interacts with the earthen formation it engages while drilling.

Figure 4:
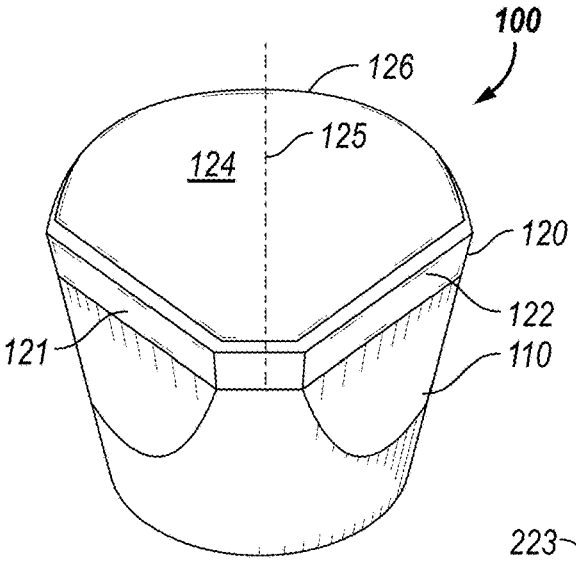
FIG. 4 is a perspective view further detailing the shaped cutter of FIG. 2.

FIG. 4 is a perspective view further detailing the shaped cutter 100 of FIG. 2, separate from any bit body. The shaped cutter 100 may initially be formed like a round cutter, with a cylindrical shape (including substrate 110 and cutting element 120), and subsequently shaped using tools developed for cutting very hard materials, such as electrical discharge machining (EDM). Alternatively, the substrate 110 and cutting element 120 may be formed by arranging loose materials (e.g., diamond powder and a cobalt catalyst) arranged in the desired end shape and pressed in an HTHP press cycle. The shaped cutting element 120 may define a directional reference line 125 along the cutting face 124. The reference line 125 in this example is a centerline between the opposing portions 121, 122. Although not required of all shaped cutters, the shaped cutting element 120 is symmetrical in this example, and the reference line 125 is more particularly an axis of symmetry in this example.

Figure 5:
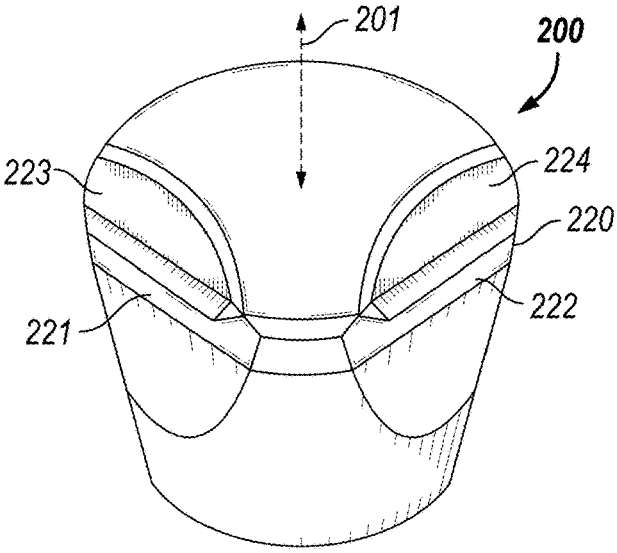
FIG. 5 is a perspective view of another example of a shaped cutter including a non-circular shape and a non-planar cutting face.

FIG. 5 is a perspective view of another example of a shaped cutter 200 including a non-circular shape and a non-planar cutting face 224. The non-circular shape is similar to the non-circular shape of the shaped cutter 100 of FIG. 3, with opposing flanks 221, 222. The shaped cutting element 220 also includes non-planar features (other than a bevel or chamfer) comprising axially recessed portions 223, 224 adjacent the respective flanks 221, 222, that may further affect the interaction with rock.

Figure 6:
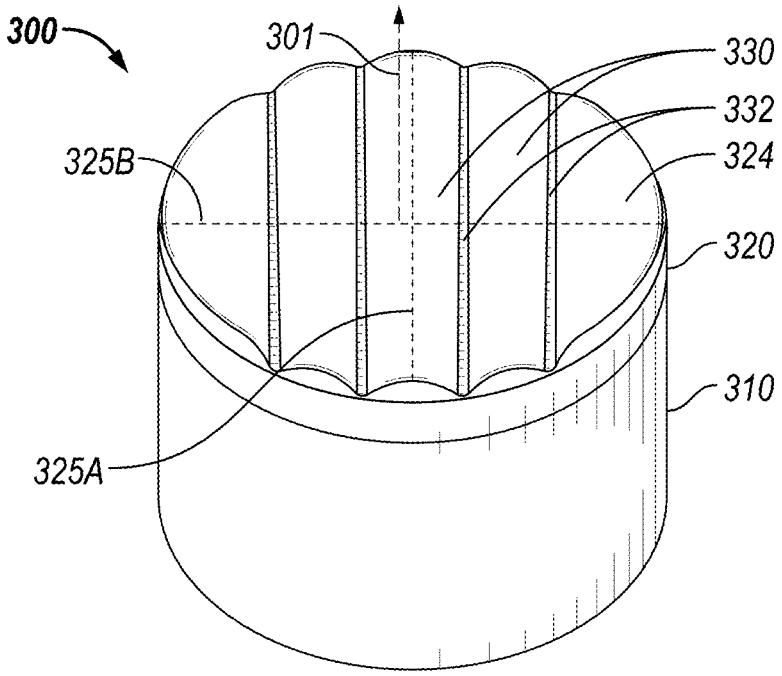
FIG. 6 is a perspective view of another example of a shaped cutter having a circular cutting element and non-planar cutting face.

FIG. 6 is a perspective view of another example of a shaped cutter 300 according to this disclosure having a shaped cutting element 320 defined by a non-planar cutting face 324. The cutting element 320 and substrate 310 are generally round on the sides of the cutter 300, and therefore have a circular cross section. However, the non-planar cutting face 324 comprises one or more depth features traversing a portion of the non-planar cutting face 324, wherein the rotational position of the shaped cutting element about the cutter axis is defined with reference to the one or more depth features. The depth features of the cutting element 320 in this example comprise a plurality of linear ridges 330 and channels 332 traversing the cutting face 324 that give the cutting element 320 directionality despite its generally circular shape. This directionality affects interaction of the cutting element 320 with rock based on the rotational position of the shaped cutter 300 about its cutter axis 301. For purposes of this disclosure, the cutter 300 is therefore considered a shaped cutter because the cutting element 320 has directionality attributable to the linear ridges 330 and channels 332 despite the generally round shape of the cutting element 320. Two possible cutting face centerlines are indicated at 325A and 325B, either of which coincide with respective axes of symmetry.

Figure 7:
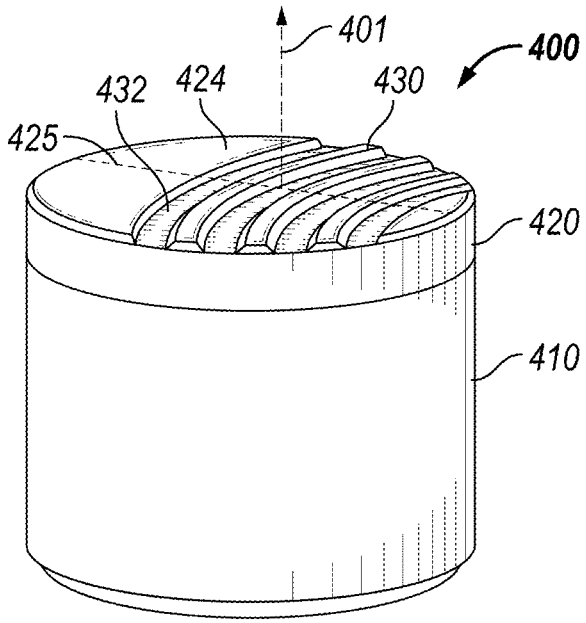
FIG. 7 is a perspective view of yet another example of a shaped cutter having a circular cutting element and non-planar cutting face.

FIG. 7 is a perspective view of yet another example of a shaped cutter 400 according to this disclosure also having a circular cutting element 420 but non-planar cutting face 424. The cutting element 420 and substrate 410 are generally round on the sides of the cutter 400. However, the cutting element 420 has depth features comprising a plurality of arcuate ridges 430 and channels 432 traversing the cutting face 424. This directionality affects interaction of the cutting element 420 with rock based on the rotational position of the shaped cutter 400 about its cutter axis 401. For purposes of this disclosure, therefore, the cutter 400 is also considered a shaped cutter because the cutting element 420 has directionality attributable to the arcuate ridges 430 and channels 432 despite the generally round shape of the cutting element 420. The region of arcuate channels 432 may also provide functionality in some drill bit designs by directing a plurality of formation cuttings away from the cutting element 420 on at least a portion of the cutting face 424.

In the foregoing examples, the shaped cutters have a directional feature (e.g., a non-circular and/or non-planar cutting face), wherein a wear imbalance may be adjusted/reduced solely by rotation of the shaped cutter about its cutter axis. Adjustments to reduce a wear imbalance are not limited solely to adjusting the rotational position about the cutter axis. Other adjustments may also be made to adjust exposure, particularly with cutting elements that lack such a directional feature.

Figure 8A:
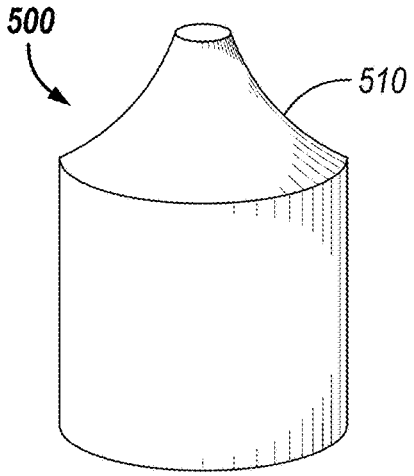
FIG. 8A is a perspective view of an example of a cutter with a tapered cutting element.
Figure 8B:
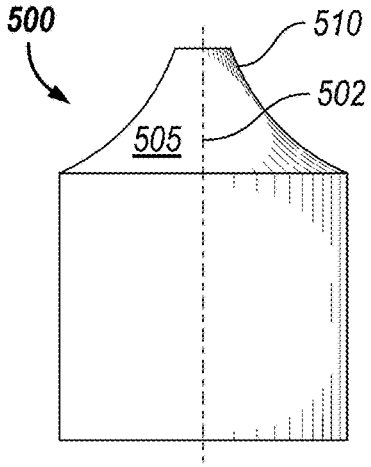
FIG. 8B is a side perspective view of the cutter of FIG. 8A.
Figure 8C:
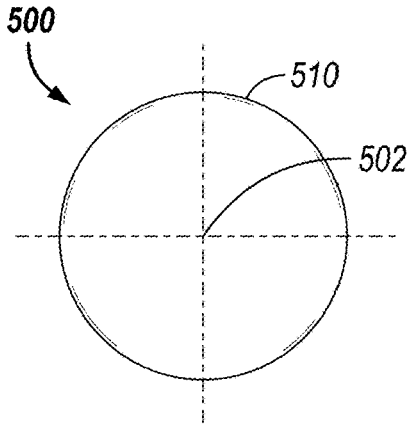
FIG. 8C is a top view of the cutter of FIG. 8A.

For example, FIGS. 8A-8C illustrate a cutter 500 with a tapered cutting element 510 (i.e., a tapered cutter. FIG. 8A is an isometric view of the tapered cutter 500 with tapered cutting element 510. FIG. 8B is a sectional view of the tapered cutter 500 through a central cutter axis 502. The tapered cutting element 510 in this view is shown as having a quasi-frustoconical shape, optionally with a slightly concave taper surface 505. FIG. 8C is a top view of the tapered cutter 500. The tapered cutting element 510 is shown in this view as having a circular cross section with a diameter that varies along the central cutter axis 502. Because of the generally circular cross-section, rotating the tapered cutter 500 about the cutter axis 502 may not appreciably adjust a wear imbalance in a way that foregoing examples do. In at least this example, therefore, the orientation of the tapered cutter 500 may be adjusted by rotation about an axis through the tapered cutter 500 other than the cutter axis 502 in order to reduce wear imbalance.

Figure 9:
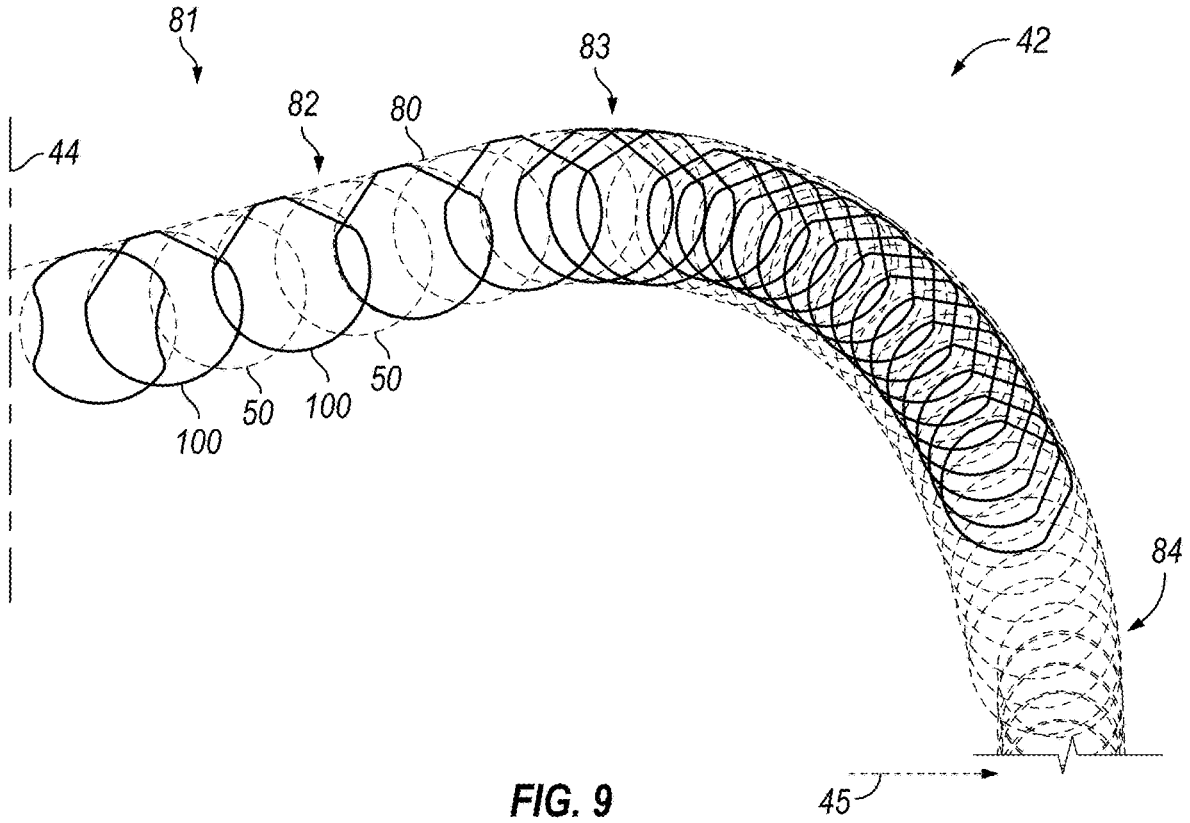
FIG. 9 is a cutting profile for a selected drill bit blade with shaped cutters disposed at a baseline orientation.

FIG. 9 is a cutting profile 80 for a selected drill bit blade 42 with the shaped cutters 100 disposed at a baseline orientation. The cutting profile 80 is a two-dimensional (2D) curve collectively defined by the outermost portions of round cutters 50 and shaped cutters 100 nearest to the formation being engaged. The blade 42 and cutting profile 80 may be analyzed as having different zones, including a cone zone 81, a nose zone 82, a shoulder zone 83, and gage zone 84, each including one or more cutter along the cutting profile 80. Cone zone 81, nose zone 82, shoulder zone 83, and gage zone 84 may be identified based on their location along blade 42 with respect to the bit axis 44 and a distance along a horizontal axis 45 from the bit axis 44 in a plane that includes bit axis the 44. A cutting face centerline 425 coincides with the only axis of symmetry defined for this particular shaped cutting element 420.

The baseline orientation of each shaped cutter 100 is defined with respect to an rotational position about the cutter axis at which that shaped cutter 100 is secured to the blade 42. In this example, the baseline orientation of the shaped cutters 100 is perpendicular to the profile tangent where the cutter axis intersects the cutting profile 80. With respect to the shaped cutter of FIG. 4, for example, the baseline orientation aligns the centerline 125 of the cutting face 124 perpendicular to the cutting profile 80 where the centerline 125 intersects the cutting profile.

Figure 10A:
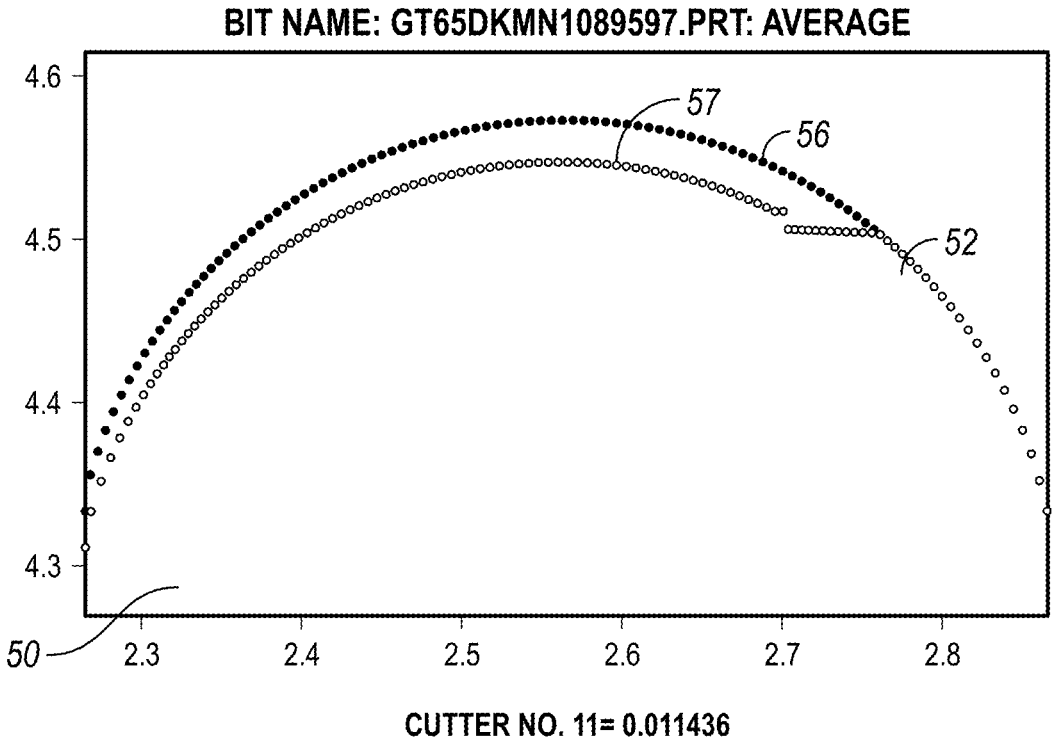
FIG. 10A is a diagram of rock engagement for a round cutter.
Figure 10B:
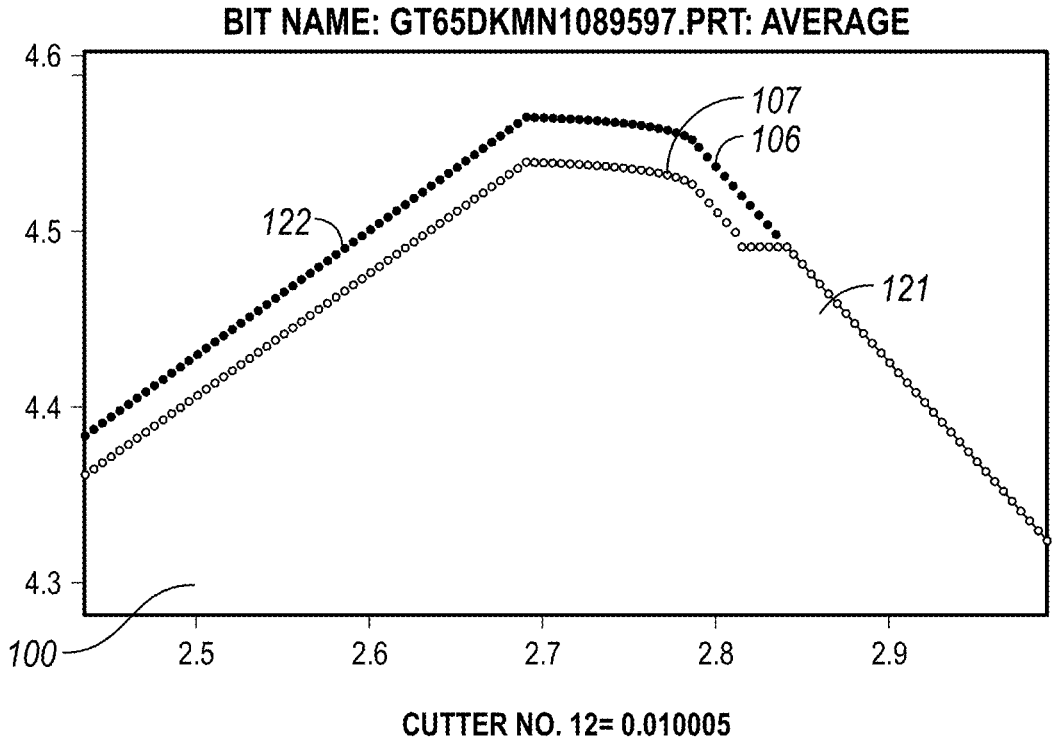
FIG. 10B is a diagram of rock engagement for a shaped cutter with the shaped cutter at the baseline orientation.

FIG. 10A is a cutter engagement diagram describing the engagement of the round cutter 50 with the formation, and FIG. 10B is a cutter engagement diagram describing the engagement of the shaped cutter 100 with the formation at the baseline orientation of the shaped cutter 100 in FIG. 9, under particular loading conditions. Each outer line 56, 106 represents the cutting edge of the respective cutter, and the inner line 57, 107 represents the formation being cut by the respective cutter 50, 100. Thus, the gap between the outer line 56, 106 and inner line 57, 107 represents the depth of engagement of the respective cutter 50, 100 with the formation. As can be seen particularly on the shaped cutter 100, one of the flanks 121 engages the formation over a greater portion of its length than the other flank 122. This lopsided engagement at the baseline orientation has been identified by this disclosure as a wear imbalance and a corresponding inefficiency of the baseline orientation of shaped cutters at least under particular loading conditions. The wear imbalance may result in preferential wear on one of the flanks 122 as compared with the opposing flank 121. One aspect of this disclosure is to at least reduce this wear imbalance by adjusting the rotational position of the shaped cutters about each of their cutter axes.

Figure 11:
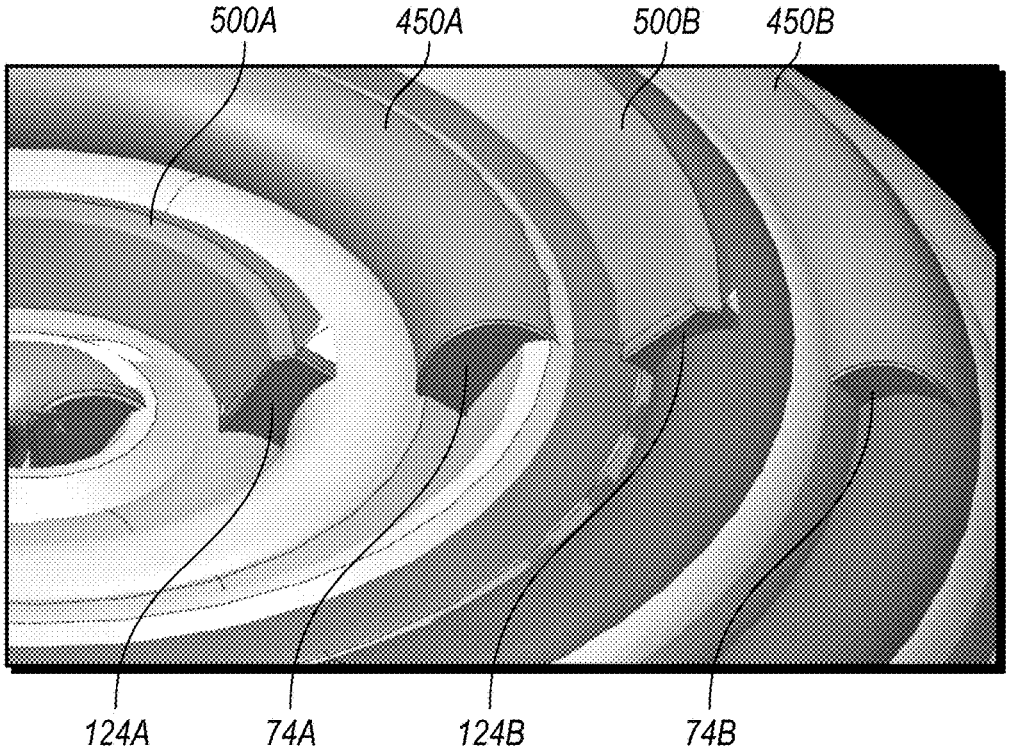
FIG. 11 is a perspective view of three-dimensional (3D) cutting profiles swept by the cutters of a drill bit with shaped cutters at the baseline orientation of FIG. 9.

FIG. 11 is a perspective view of three-dimensional (3D) cutter engagement profiles swept by the cutters of a drill bit with shaped cutters at a baseline orientation of FIG. 9. This simulates, in 3D, the cutter area of engagement depicted in FIG. 10. For example, two of the 3D profiles 450A, 450B are swept by round cutters and two of the 3D profiles 500A, 500B are swept by shaped cutters. The cutters are positioned on the drill bit so that the individual 3D cutting profile swept by each cutter may overlap with 3D cutting profiles swept by one or more cutter on one or more other blade, as the cutters collectively cut the formation when drilling. Cutters on other blades whose 3D profiles overlap with a given cutter may cut the formation a fraction of a second prior to engagement of that given cutter. Thus, only a portion of the respective cutting faces 74A, 74B of the round cutters and of cutting faces 124A, 124B of the shaped cutters are potentially exposed to uncut formation at any given point in the rotation. As can be seen particularly with the 3D profiles 500A, 500B, the exposure of the shaped cutters to the formation will be greater on one flank than on the other at the baseline orientation, resulting in the uneven engagement with the formation indicated in FIG. 10 and resulting wear imbalance.

Figure 12:
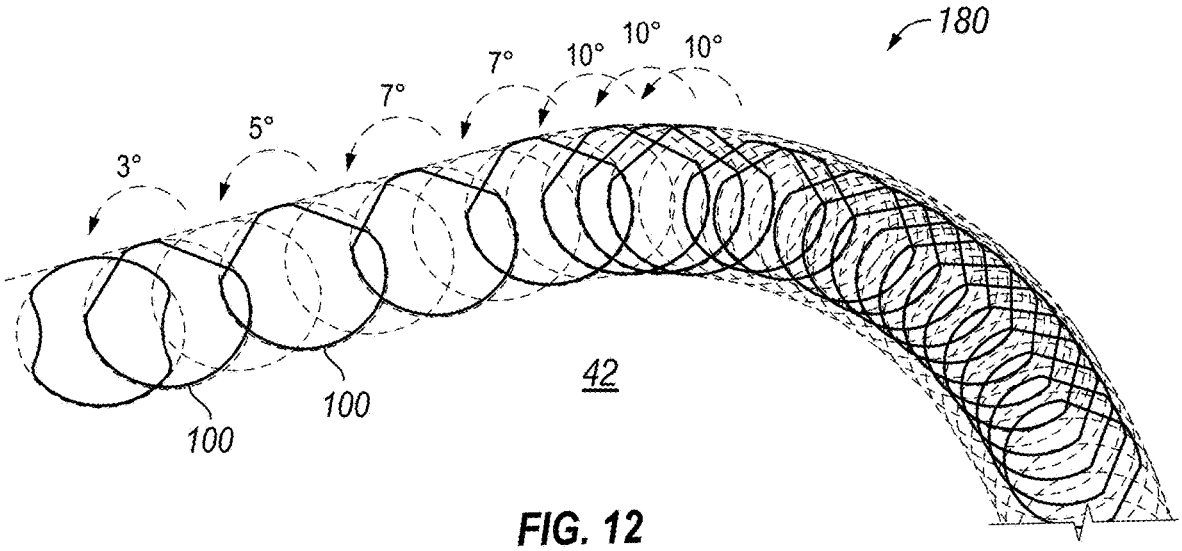
FIG. 12 is an adjusted cutting profile for a selected drill bit blade expected to reduce the wear imbalance associated with the baseline orientation of FIG. 9.

FIG. 12 is an adjusted cutting profile 180 for a selected drill bit blade 42 expected to reduce the wear imbalance associated with the baseline orientation of FIG. 9. The orientation for at least some shaped cutters 100 has been rotated away from the perpendicular baseline orientation of FIG. 9. The degrees of adjustment away from perpendicular may vary from cutter to cutter, such as according to a design methodology, an electronic drilling simulation, and/or from field or testing data indicating cutter wear at the baseline orientations.

The rotational adjustments in this example range from between three degrees to ten degrees per cutter. Examples of this angular adjustment of the cutters about the respective cutter axes are illustrated in FIG. 12, such as 3 degrees, 5 degrees, 7 degrees, and 10 degrees of angular adjustment. The rotational adjustment may be in a rotational direction that at least reduces the wear imbalance on opposing portions of the cutting face, even if the adjusted orientation does not eliminate the wear imbalance. For example, if it is determined that too large of an adjusted orientation may result in diminishing of some other performance parameter, the value of the adjusted orientation may be appropriately limited to balance the desirable reduction in wear imbalance with other performance parameters that may be affected.

Figure 13:
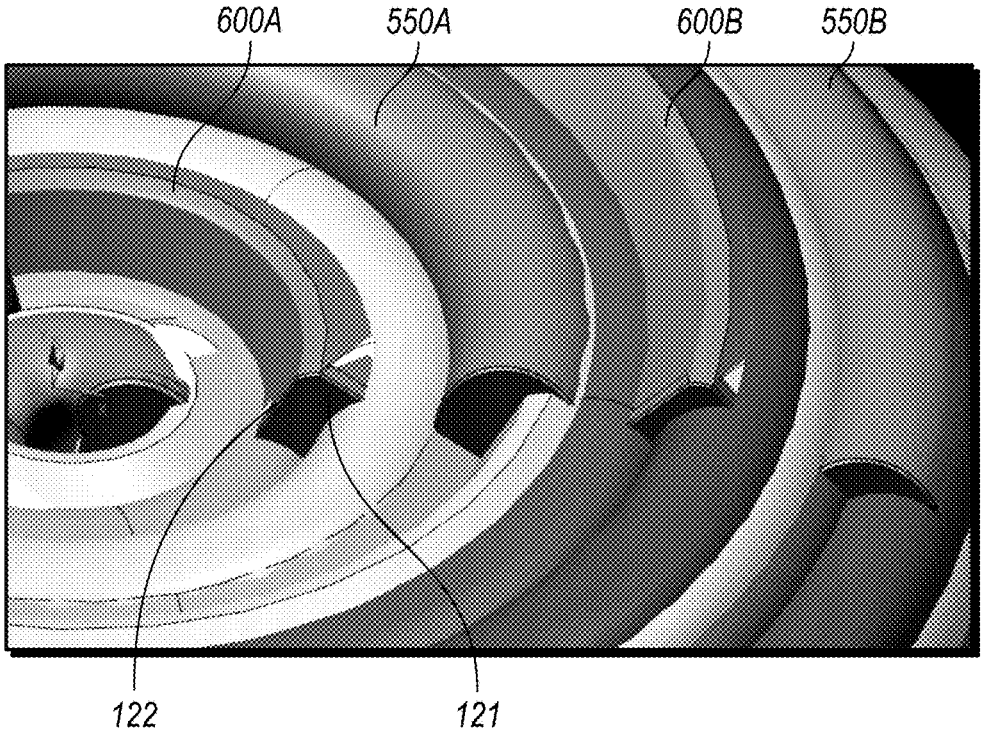
FIG. 13 is a perspective view of three-dimensional (3D) cutting profiles swept with the shaped cutters at their adjusted orientations of FIG. 12.

FIG. 13 is a perspective view of three-dimensional (3D) cutting profiles swept with the shaped cutters at their adjusted orientations of FIG. 12. For example, two of the 3D profiles 550A, 550B are swept by round cutters (whose orientations are unchanged compared to FIG. 11) and two of the 3D profiles 600A, 600B are swept by shaped cutters having been moved from the baseline orientations of FIG. 10 to the adjusted orientations of FIG. 12. With reference to the rotational adjustments from baseline noted in FIG. 12, the profile 600A represents a different rotational adjustment than the profile 600B. Particularly with the 3D profile 600A the exposure of that shaped cutter to the formation is much more uniform as compared with FIG. 11, resulting in a more uniform engagement of the flanks 121, 122. Any wear imbalance has at least been reduced. The adjusted orientation of the shaped cutter forming the 3D profile 600A may substantially align a centerline of its cutting face (see FIG. 4) with a centroid of earthen material the opposing portions are exposed to cut. In some cases, the adjusted orientation of each shaped cutter may align a centerline of the cutting face between the opposing portions of the shaped diamond cutting element with a centroid of earthen material the opposing portions are exposed to cut. Given that the 3D profiles may vary based on drilling parameters such as formation type and composition, rotational velocity of the drill bit and rate of penetration. The adjusted orientation for each shaped cutter may be generated for the centroid at a maximum, minimum or average rate of penetration.

Figure 14:
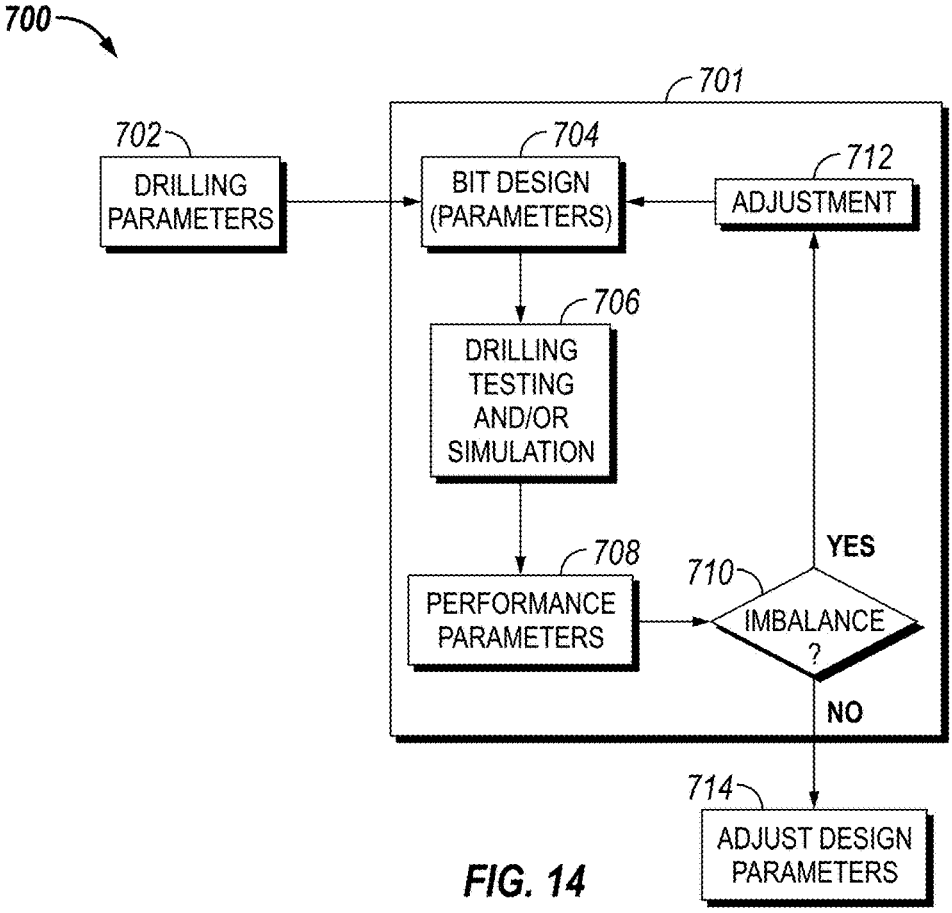
FIG. 14 is a block diagram of a drill bit design system for implementing a design method according to one or more embodiments of the disclosure

FIG. 14 is a block diagram of a drill bit design system 700 for implementing a design method according to one or more embodiments of the disclosure. The system 700 may be implemented at least part on a general purpose computer system or on an electronic system specifically tailored for drill bit design. The system 700 may include short-term and long-term memory modules, one or more processor for processing inputs and generating outputs, and one or more user interface peripherals such as input devices (e.g., keyboard, mouse, and stylus), output devices (e.g., audio and video), not expressly shown. The system thus embodies and implement various logic 701 for receiving certain design inputs and generating certain outputs.

Relevant design inputs may include one or more drilling parameters 702. Drilling parameters 702 may include any parameters of a planned or prospective wellbore to be drilled that could influence bit design intended for that purpose, including but not limited to formation type and composition, and parameters of the drill bit such as rotational velocity of the drill bit and rate of penetration.

The bit design may be defined by a plurality of bit design parameters 704, including but not limited to drill bit type, number and type of blades, and the cutters to be used. Some drill bit design parameters 704 affecting bit performance are specifically related to the cutters, including but not limited to cutter type, cutter shape, the number of cutters, their spacing, position, and orientation. The bit design parameters 704 may be informed by the particular drilling parameters 702 input, in which case the logic 701 may comprise logic for selecting values for the various bit design parameters 704 at least partially based on the input drilling parameters 702.

One bit design parameter 704 of this disclosure relates to the positioning and orientation of the shaped cutters, including an rotational position of the shaped cutting element about a longitudinal axis of the shaped cutter. Initially, the bit design parameters 704 may comprise a baseline orientation of a shaped cutter with respect to a bit body, wherein the shaped cutter includes a shaped cutting element secured to a substrate. The baseline orientation may be defined with respect to an rotational position of the shaped diamond cutting element about a longitudinal axis of the shaped cutter.

The bit design, represented by the various bit design parameters 704 and the relationships therebetween, may then be evaluated by testing or simulation logic 706 to determine a wear imbalance between opposing portions of the shaped diamond cutting element at the baseline orientation. If wholly implemented on the electronic system, the simulation may be an electronic drilling simulation based on the bit design parameters 706 and the drilling parameters 702. Alternatively, or as a supplemental investigation tool, a physical test bit could be formed using any baseline parameters, including the baseline orientation of the shaped cutter(s), and tested in a physical test well.

Drill bit performance parameters 708 may then be generated based on the simulation/testing 706 of the particular bit design being evaluated. The bit performance parameters may characterize how the drill bit (simulated bit or test bit) performed using the current bit design parameters 704. The performance parameters 708 may include, for example, drilling speed and efficiency, rate and depth of penetration, borehole quality, durability, force balancing, stick-slip reduction, and cutter wear, such as uniformity of cutter wear on shaped cutters. More particularly, the drill bit performance parameters 708 may comprise any wear imbalance on shaped cutters, such as on opposing portions of a cutting face on either side of an engagement portion (e.g., cutter tip) of the cutter with the formation.

Decisional logic 710 identifies any performance parameters that are deficient (may be improved), such as a wear imbalance on shaped cutters. If such a wear imbalance or other deficiency is identified, an adjustment 712 may be made to one or more bit design parameters 704 relevant to that performance deficiency, and an adjusted bit design may then be simulated/tested. Thus, the design method may be iterative, wherein the initial design parameters may be baseline design parameters and subsequent iterations use adjusted design parameters 714 to compare the resulting performance parameters 708.

In one example, the adjustment 712 comprises an adjusted orientation of the shaped cutter having a different rotational position of the shaped cutting element about the cutter axis expected to reduce the wear imbalance identified by decisional logic 710. The adjusted orientation may be some angle about the cutter axis that reduces the wear imbalance. In some examples, this adjustment may align the shaped cutter with a centroid of formation to be cut by that cutter. Since drilling parameters 702 may influence the cutting pattern (e.g., drilling slope), then the adjustment for each shaped cutter may be generated for the centroid at a maximum, minimum or average rate of penetration. In this context, the Drilling slope may comprise a helical path of each cutter, determined by the rate of penetration and rotational speed in terms of, for example, revolutions per minute (RPM), that a cutter follows as it cuts the borehole.

Accordingly, the present disclosure provides a drill bit and methods for more optimal positioning and orientation of shaped cutters. The disclosed embodiments may improve drilling performance in terms of efficiency, wear uniformity, and other performance related characteristics. Embodiments of this disclosure may include any of the various features disclosed herein, in any suitable combination, including but not limited to the examples in the following statements.

Statement 1. A method of designing a drill bit, comprising: obtaining a baseline orientation of a shaped cutter with respect to a bit body, the shaped cutter including a shaped cutting element secured to a substrate, the baseline orientation at least partially defined with respect to a rotational position of the shaped cutting element about a longitudinal axis of the shaped cutter; determining a wear imbalance between different portions of the shaped cutting element exposed to wear at the baseline orientation; and generating an adjusted orientation of the shaped cutter expected to reduce the wear imbalance.

Statement 2. The method of Statement 1, further comprising generating an electronic model of the drill bit with the shaped cutter at the baseline orientation, wherein determining the wear imbalance comprises performing an electronic drilling simulation of the drill bit with the shaped cutter at the baseline orientation.

Statement 3. The method of Statement 1 or 2, further comprising forming a physical test drill bit with the shaped cutter at the baseline orientation, wherein determining the wear imbalance comprises drilling with the physical test drill bit to generate wear on the opposing portions of the shaped cutting element.

Statement 4. The method of Statement 3, further comprising securing a new shaped cutter to a new drill bit at the adjusted orientation to compensate for the wear imbalance of the test drill bit.

Statement 5. The method of any of Statements 1 to 4, wherein generating the adjusted orientation of the shaped cutter comprises changing the rotational position of the shaped cutting element about the longitudinal axis of the shaped cutter.

Statement 6. The method of Statement 5, wherein the different portions of the shaped cutting element exposed to wear are flanks on opposing sides of a centerline of the cutting face.

Statement 7. The method of any of Statements 1 to 6, wherein the shaped cutting element comprises a non-circular cutting face, and wherein the opposing portions are opposing radial reliefs on either side of a centerline of the non-circular cutting face.

Statement 8. The method of Statement 7, wherein the centerline of the cutting face coincides with an axis of symmetry of the cutting face between the opposing radial reliefs.

Statement 9. The method of any of Statements 1 to 8, wherein the shaped cutting element comprises a non-planar cutting face with one or more depth features traversing a portion of the non-planar cutting face, wherein the rotational position of the shaped cutting element about the longitudinal axis is defined with reference to the one or more depth features.

Statement 10. The method of Statement 9, wherein the one or more depth features comprises one or more ridges or channels along the shaped cutting element.

Statement 11. The method of any of Statements 1 to 10, wherein the adjusted orientation of each shaped cutter aligns a centerline between the opposing portions of the shaped cutting element with a centroid of earthen material the opposing portions are exposed to cut.

Statement 12. The method of Statement 11 wherein the adjusted orientation of each cutter is generated for the centroid at a maximum, minimum or average rate of penetration.

Statement 13. The method of any of Statements 1 to 12, wherein the baseline orientation aligns a centerline of the shaped cutting element between the different portions of the shaped cutting element perpendicular to a cutting profile defined by a plurality of fixed cutters including the shaped cutter along a blade of the bit body.

Statement 14. A drill bit, comprising: a drill bit body comprising a blade; a plurality of fixed cutters secured to the blade, the fixed cutters collectively defining a cutting profile for the blade; and a shaped cutter included with the plurality of fixed cutters, the shaped cutter having a shaped cutting element with a cutting face defining a cutting face centerline, the shaped cutter secured to the blade at a fixed rotational position about a longitudinal axis of the shaped cutter wherein the cutting face centerline is angled away from a a perpendicular line to the cutting profile.

Statement 15. The drill bit of Statement 14, wherein the shaped cutting element comprises a non-circular cutting face, and wherein the shaped cutting element comprises flanks exposed to wear on opposing sides of the cutting face centerline.

Statement 16. The method of Statement 15 wherein the flanks comprise opposing radial reliefs on either side of the cutting face centerline.

Statement 17. The method of Statement 16, wherein the cutting face centerline coincides with an axis of symmetry of the cutting face between the opposing radial reliefs.

Statement 18. A method of drilling a wellbore, comprising: axially engaging a drill bit with an earthen formation to be drilled, the drill bit comprising a plurality of fixed cutters along a blade, the fixed cutters including a shaped cutter having a shaped cutting element with a cutting face centerline, the shaped cutter secured to the bit body with its cutting face centerline rotated to an angle away from perpendicular to a cutting profile defined by the plurality of fixed cutters along the blade; and rotating the drill bit to cut the earthen formation with the plurality of fixed cutters including the shaped cutter.

Statement 19. The method of Statement 18, further comprising: drilling a test wellbore with a test drill bit having a shaped test cutter with a cutting face centerline oriented perpendicular to the cutting profile to generate wear on opposing portions of the cutting face exposed to wear on opposing sides of the cutting face centerline; determining a wear imbalance between the portions of the cutting face exposed to wear; and using the wear imbalance resulting from drilling the test wellbore to determine an angle away from the perpendicular to reduce the wear imbalance.

Statement 20. The method of Statement 18 or 19, further comprising: adjusting an orientation of the shaped cutter to align the cutting face centerline with respect to a centroid of earthen material the opposing portions of the cutting face are exposed to cut.

To facilitate a better understanding of the present invention, the following examples of certain aspects of some embodiments are given. In no way should the following examples be read to limit, or define, the entire scope of the disclosure.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present embodiments are well adapted to attain the ends and advantages mentioned as well as those that are inherent therein. The particular embodiments disclosed above are illustrative only, as the present embodiments may be modified and practiced in different but equivalent manners apparent to those skilled in the art having the benefit of the teachings herein. Although individual embodiments are discussed, all combinations of each embodiment are contemplated and covered by the disclosure. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of the present disclosure.

What is claimed is:

1. A method of designing a drill bit, comprising:

obtaining a baseline orientation of a shaped cutter with respect to a bit body, the shaped cutter including a shaped cutting element secured to a substrate, wherein the shaped cutting element includes a non-planar cutting face having at least one depth feature traversing a portion of the non-planar cutting face, wherein a rotational position of the shaped cutting element is defined with reference to the at least one depth feature, wherein the baseline orientation is at least partially defined with respect to the rotational position of the shaped cutting element about a longitudinal axis of the shaped cutter;

generating an electronic model of the drill bit with the shaped cutter at the baseline orientation;

determining a wear imbalance between different portions of the shaped cutting element exposed to wear at the baseline orientation, wherein determining the wear imbalance comprises performing an electronic drilling simulation of the drill bit with the shaped cutter at the baseline orientation; and generating an adjusted orientation of the shaped cutter expected to reduce the wear imbalance, wherein generating the adjusted orientation of the shaped cutter comprises changing the rotational position of the shaped cutting element about the longitudinal axis of the shaped cutter.

2. The method of claim 1, further comprising forming a physical test drill bit with the shaped cutter at the baseline orientation, wherein determining the wear imbalance comprises drilling with the physical test drill bit to generate wear on the respective flanks of the shaped cutting element.

3. The method of claim 2, further comprising securing a new shaped cutter to a new drill bit at the adjusted orientation to compensate for the wear imbalance of the test drill bit.

4. The method of claim 1, wherein the different portions of the shaped cutting element exposed to wear are flanks on opposing sides of a centerline of the non-planar cutting face.

5. The method of claim 1, wherein the non-planar cutting face is non-circular, and wherein respective flanks are opposing radial reliefs on either side of a centerline of the non-planar cutting face.

6. The method of claim 5, wherein the centerline of the non-planar cutting face coincides with an axis of symmetry of the non-planar cutting face between the opposing radial reliefs.

7. The method of claim 1, wherein the shaped cutting element comprises a non-planar cutting face with one or more depth features traversing a portion of the non-planar cutting face, wherein the rotational position of the shaped cutting element about the longitudinal axis is defined with reference to the one or more depth features.

8. The method of claim 7, wherein the one or more depth features comprises one or more ridges or channels along the shaped cutting element.

9. The method of claim 1, wherein the adjusted orientation of each shaped cutter aligns a centerline between respective flanks of the shaped cutting element with a centroid of earthen material the shaped cutting element is configured to cut.

10. The method of claim 9 wherein the adjusted orientation of each cutter is generated for the centroid at a maximum, minimum or average rate of penetration.

11. The method of claim 1, wherein the baseline orientation aligns a centerline of the shaped cutting element between the different portions of the shaped cutting element perpendicular to a cutting profile defined by a plurality of fixed cutters including the shaped cutter along a blade of the bit body.

12. The method of claim 1, further comprising obtaining at least one additional bit design parameter, wherein the additional bit design parameters include a cutter shape of the shaped cutter, a cutter type of the shaped cutter, or some combination thereof.

13. The method of claim 12, adjusting the at least one additional bit design parameter based at least in part on the determined wear imbalance between the different portions of the shaped cutting element.

14. The method of claim 1, further comprising:

determining at least one additional drill bit performance parameter, wherein the additional drill bit performance parameter includes drilling speed and efficiency, rate and depth of penetration, borehole quality, durability, force balancing, stick-slip reduction, or some combination thereof, and generating the adjusted orientation of the shaped cutter based at least in part on the at least one additional drill bit performance parameter and the determined wear imbalance between the different portions of the shaped cutting element.

* * * * *